US009663122B2

(12) United States Patent
Watts et al.

(10) Patent No.: US 9,663,122 B2
(45) Date of Patent: May 30, 2017

(54) BUFFER

(71) Applicant: T A Savery & Co., Ltd., Coventry (GB)

(72) Inventors: Carl Francis Watts, Culworth (GB); Terence Williams, Coventry (GB)

(73) Assignee: T A Savery & Co., LTD (GB)

( * ) Notice: Subject to any disclaimer, the term of this patent is extended or adjusted under 35 U.S.C. 154(b) by 228 days.

(21) Appl. No.: 14/478,088

(22) Filed: Sep. 5, 2014

(65) Prior Publication Data

US 2015/0069003 A1 Mar. 12, 2015

(30) Foreign Application Priority Data

Sep. 6, 2013 (GB) ..... 1315935.5

(51) Int. Cl.
*B61G 11/16* (2006.01)

(52) U.S. Cl.
CPC ..... *B61G 11/16* (2013.01)

(58) Field of Classification Search
CPC ..... B61G 11/16; B61G 11/08; B61G 11/06; B61G 9/06; B61G 5/02; B61G 11/12;
(Continued)

(56) References Cited

U.S. PATENT DOCUMENTS

2007/0175851 A1* 8/2007 Hogbring ..... B60D 1/50 213/62 R
2009/0065462 A1* 3/2009 Gansweidt ..... B61G 7/10 213/1 A (Continued)

FOREIGN PATENT DOCUMENTS

DE 10037050 2/2002
DE 102 52 175 5/2004

(Continued)

OTHER PUBLICATIONS

Lorandi, Lorenzo, European Search Report, Jan. 14, 2015, 5 pages, European Patent Office, Munich, Germany.

(Continued)

*Primary Examiner* — Mark Le
(74) *Attorney, Agent, or Firm* — Mark A. Oathout; Oathout Law Firm

(57) ABSTRACT

A buffer comprising a first, elongate buffer element that is moveably received within the interior of a second, elongate, hollow buffer element such that the first and second buffer elements overlap over part of their length, such that the buffer elements define a hollow interior of the buffer and such that at an end of the buffer at least the second buffer element is exposed for engagement with a respective, further member, the first and second buffer elements being moveable between a first, extended or intermediate configuration of the buffer and a second, compressed configuration, compression of the buffer more energetically than a threshold energy level causing the first buffer element to energize a non-recoverable energy absorbing member, forming part of the buffer or capsule, to cause deformation of one or more plastically deformable parts of the buffer, characterized in that the non-recoverable energy absorbing member lies between the ends of the buffer at least in the region energized by the first buffer element.

18 Claims, 6 Drawing Sheets

(58) Field of Classification Search
CPC .. F16F 7/125; F16F 7/12; B60R 19/34; B61D 15/06
See application file for complete search history.

(56) References Cited

U.S. PATENT DOCUMENTS

| | | | | |
|---|---|---|---|---|
| 2009/0151595 | A1 | 6/2009 | Kontetzki | |
| 2012/0031299 | A1* | 2/2012 | Kontetzki | B60R 19/34 105/392.5 |

FOREIGN PATENT DOCUMENTS

| | | |
|---|---|---|
| EP | 1 247 716 | 10/2002 |
| EP | 1 637 426 | 3/2006 |
| EP | 1905661 | 4/2008 |
| FR | 2836108 | 8/2003 |
| GB | 2 281 114 | 2/1995 |
| WO | 20051075272 | 8/2005 |
| WO | 20101071468 | 6/2010 |

OTHER PUBLICATIONS

Churchill,Brendan, Combined Search and Examination Report under Sections 17 and 18(3), Apr. 28, 2014, 7 pages, UK Intellectual Property Office,South Wales, UK.

* cited by examiner

BUFFER

This invention relates to a buffer. In particular the invention relates to a buffer that is suitable for use on heavy vehicles such as but not limited to railway locomotives, trams, "light rail" cars, ore trains, railway wagons, railway carriages and some earth-moving machines. The primary application of the buffer of the invention is in impact protection for vehicles that travel on permanent way and in particular conventional railways.

It has for long been known to provide buffers to act as force absorbers for the purpose of absorbing low speed impact energy when railway vehicles run in to one another.

Conventional buffers however are designed to cope with vehicle impacts occurring at shunting speeds of typically less than 15 km/h or while rail cars are running in a train. Most buffers are not capable of absorbing the high energy that is generated at higher impact velocities than arise when shunting, such as occur during a crash.

A typical conventional buffer includes a hollow tubular housing that is longitudinally compressible by reason of including first and second buffer elements one of which is longitudinally slideable inside the hollow interior of the other.

A compressible buffer capsule interconnects the first and second elements inside the buffer. The buffer capsule contains (usually) a hydraulic oil that on compression of the buffer is forced to flow via various energy-dissipating paths in order to attenuate the energy that causes compression of the buffer as a whole. In other buffer designs as would be known by the person of skill in the art the buffer capsule may contain a fluid elastomer or another, similar substance; or the function of the buffer capsule may be provided by a resiliently deformable ring spring, rubber pads or polymer pads. The invention relates to all such classes of buffer. Buffers of the kind described above are sometimes referred to as recoverable buffers or recoverable buffer elements.

The buffer capsule is the section of the buffer that provides low-speed energy absorption, but it is not capable of attenuating the high energy that arises in higher speed impacts.

Another type of energy absorber used in the railway industry is a deforming tube (or another deforming structure). The idea underlying this type of absorber is to provide for plastic deformation of a material such as a metal alloy during compression of the absorber structure. In deforming tubes one relatively rigid, rod-like member having a tapered end is received inside the hollow interior of another, cylindrical member having an internal taper of complementary cross-section to the end of the rigid member. When an impact occurs the rigid member is driven further inside the interior of the cylinder, ironing the material of the wall in the vicinity of the taper. This causes the taper in the cylinder to travel along the cylinder in a predictable manner that absorbs impact energy.

A different kind of deforming structure is described in FR-A-2789358 in which on an impact occurring one member deforms another, in an energy-absorbing fashion, by machining the material of the latter.

EP-A-1247716 describes a two-stage buffer in which a conventional buffer is combined in series with a deforming tube such that the deforming tube is mounted as an elongate extension at the end of an otherwise largely conventional buffer construction.

The buffer of EP-A-1247716 provides good performance in particular in situations in which side impacts are likely, but the buffer design is not suitable for construction e.g. as a coupler. This is because the deforming tube is designed to secure at its end opposite the buffer to a rigid part of a vehicle frame.

Buffers that operate to cause e.g. plastic deformation, or machining, of a material are sometimes referred to as non-recoverable buffers or non-recoverable buffer elements.

It is however increasingly important to provide buffers in the form of couplers that are capable of releasably securing at each end to a further component, such as another coupler or part of a vehicle.

One design in particular that is in widespread use is a so-called muff-to-muff coupler, in which at each end the coupler is formed as a cylinder having formed in its exterior an annular groove, or multiple grooves.

The direct coupling of buffers may be achieved through the use of such a muff end. When the muff end is placed adjacent another, similar muff end a muff coupling consisting of a pair of semi-annular coupling elements may be used to join the two buffers together.

The semi-annular elements of the muff coupling include on their radially inner surfaces protruding ridges that when the elements are placed so as to encircle the abutting buffer ends are received in the annular grooves. The coupling elements can be secured together using bolts or screws to create a union that is extremely strong both in tension (draft) and compression (buff).

The invention seeks to provide a buffer that (a) performs well during normal low speed impact absorption, through use of a recoverable buffer element as described; (b) incorporates a non-recoverable energy absorbing element that is capable of attenuating higher-speed impacts; (c) is useable as a coupler without any significant need for modification and (d) is compact in length.

In accordance with the invention in a broad aspect there is provided a buffer or buffer capsule comprising a first, elongate, hollow buffer element inside which is moveably received a second, elongate, buffer element such that the first and second buffer elements overlap over part of their length, such that the buffer elements define a hollow interior of the buffer and such that at an end of the buffer at least the first buffer element is exposed for engagement with a respective, further member, the first and second buffer elements being moveable between a first, extended or intermediate configuration of the buffer and a second, compressed configuration, compression of the buffer more energetically than a threshold energy level causing the second buffer element to energise a non-recoverable energy absorbing member, forming part of the buffer or capsule, to cause deformation of one or more plastically deformable parts of the buffer, characterised in that the non-recoverable energy absorbing member lies between the ends of the buffer at least in the region energised by the first buffer element.

Such an arrangement advantageously combines conventional buffer and non-recoverable energy absorbing element functions in a compact arrangement. Thus as described in more detail below the buffer of the invention when required to absorb relatively low speed impacts performs in the manner of a conventional buffer; and when required to attenuate higher speed impacts operates in the manner of a deforming tube or other non-recoverable energy absorber, while providing for a compact arrangement. The fact that at least the first element includes an exposed portion that is engageable with a further member means that at least one end the buffer inherently is configured for connection as a coupler.

Combining the reversible energy absorber with the non-reversible energy absorbing element in the same buffer between muff or other types of ends reduces the overall length required to achieve the two functions separately. This is achieved because the overlap between the first and second members of the buffer gives stability to both the recoverable and non-recoverable components of the buffer and because there is no need for a further connection between two separate devices.

In preferred embodiments of the invention the non-recoverable energy absorbing element is a deforming tube that lies externally of the second buffer element. In other embodiments of the invention described in more detail below the non-recoverable energy absorbing member may lie internally of the second buffer element. In some embodiments the non-recoverable energy absorbing member may additionally lie externally of the first buffer element. The non-recoverable energy absorbing member may within the scope of the invention take a variety of forms.

The presence of the non-recoverable energy absorbing member externally of the second buffer element confers flexibility on the design in that the non-recoverable energy absorbing member may be provided with coupler features (such as but not limited to a muff end) or it may in some embodiments of the invention be secured to a further member that includes a coupler feature (that again may be, but need not necessarily be, a muff end).

In some embodiments of the invention the non-recoverable energy absorbing member encircles the second buffer element, leading to a particularly short overall buffer length.

Preferably the non-recoverable energy absorbing member is plastically deformable and compression of the buffer more energetically than the threshold level causes plastic deformation of the non-recoverable energy absorbing member. The non-recoverable energy absorbing member therefore in preferred embodiments of the invention may adopt the principles of per se known deforming tubes and other deforming members. However it is within the scope of the invention for the non-recoverable energy absorbing member to operate in accordance with other high-energy impact attenuation principles.

Conveniently the buffer includes an energy absorber acting between the first and second buffer elements. More specifically in preferred embodiments of the invention compression of the buffer less energetically than the threshold energy level causes buffering of compression forces through operation of the energy absorber.

Such features permit the buffer to operate effectively as a conventional buffer when low-speed (e.g. less than 15 km/h) impacts occur.

In preferred embodiments of the invention a deforming member encircles part of the second buffer element. This firstly permits the buffer of the invention to be longitudinally compact. This may be achieved by reason of the deforming member over part of the length of the buffer overlapping at least the second element in a longitudinal direction.

Secondly the use of an encircling deforming member permits the use of an annular construction that is known in the buffer art to provide ease of manufacture and assembly coupled with predictable performance in terms of strength, energy absorption/attenuation and deformation characteristics.

In several particularly preferred embodiments of the invention the second buffer element includes formed integrally therewith or secured thereto an annular element taper and the deforming member includes a hollow tube having a pre-deformed section of tube so that the internal tube taper is of complementary cross-section to the element taper, the element taper and the tube taper being engageable one with the other on compression of the buffer more energetically than the threshold energy level to cause deformation of the tube commencing at the tube taper. The inventors have found such a construction to provide particularly good performance.

Preferably the buffer of the invention includes an annular taper member encircling the second buffer element in order to define the element taper. Such a construction further provides for uniform performance, in particular in terms of ensuring that deformation of the deforming member occurs without the first element deviating from alignment with the longitudinal axis of the buffer.

Also preferably the exterior of the deforming member tapers generally parallel to the tube taper inside the deforming member. The location of the external taper alters longitudinally along the length of the impact member as deformation of it occurs. The feature therefore provides an immediate visual indication of whether the impact member has been deformed, and hence of whether the buffer has suffered a high-energy impact (in which case the non-recoverable energy absorbing member should be checked and/or replaced).

Since the first buffer element is intended to engage a further member, preferably the first element includes a coupler for coupling its exposed end to a further member.

In one class of embodiments of the invention the non-recoverable energy absorbing member includes a coupler for coupling an end of the buffer to a further member. In such embodiments therefore the deforming member advantageously couples to a further member (such as but not limited to an end of a further buffer of e.g. an adjacent vehicle) thereby providing for a compact, dual function, energy absorbing coupler.

In another class of embodiments however the buffer of the invention may include a cylindrical hollow sleeve or shroud encircling the deformable member over at least part of its length. Such a cylindrical sleeve/shroud may include a coupler for coupling an end of the buffer to a further member.

In such an arrangement the cylindrical sleeve/shroud therefore is connected to the non-recoverable energy absorbing member so that the buffer as a whole may perform as an impact-absorbing buffer without the non-recoverable energy absorbing member itself having to provide a coupling function, this instead being provided by the shroud. In some circumstances this can provide for manufacturing and/or performance advantages. The shroud moreover may be made long enough to overlap most or all of the length of the buffer thereby protecting the first and second buffer elements and the non-recoverable energy absorbing member from contamination or damage and also assuring lateral stability of the parts of the buffer even when impact forces are not completely aligned with the longitudinal axis of the buffer.

Regardless of which of the classes of device into which embodiments of the invention fall, at least one end of the of the buffer has a muff end to allow the buffer to perform the function of a coupling or part of a coupling, the coupler of the deformable member and the coupler of the cylindrical sleeve preferably being in each case a muff-type coupler.

Conveniently at least one energy absorber is or includes a hydraulic buffer capsule that interconnects the first and second buffer elements inside the buffer. Such a buffer capsule may take any of a range of forms. Exemplary embodiments are described herein, although other types of buffer (that typically do, but need not, operate using hydraulic oil) are possible within the scope of the invention.

In preferred embodiments of the invention the energy absorber includes an energy store. An energy store may be employed for the purpose of restoring the energy absorber to an uncompressed configuration following compression in a low-energy impact that is not sufficient to cause the first buffer element to press into the non-recoverable energy absorbing member.

The second buffer element may be pre-engaged with the non-recoverable energy absorbing member, or may be initially disengaged therefrom such that an initial stage of pressing of the second buffer element into the non-recoverable energy absorbing member involves engagement of the two components in question.

The energy store may preferably be or may include a resiliently deformable spring acting between the first and second buffer elements inside the interior of the buffer. More specifically, in preferred embodiments of the invention the spring includes a gas spring or a ring spring which latter optionally may be designed to accommodate draft loads.

Thus the energy store may be constituted as a feature or construction that is known in the buffer art to be reliable and economical to manufacture.

In further embodiments of the invention in which preferably but not necessarily the non-recoverable energy absorbing member takes in general a different form than the kind defined in relation to the embodiments described above, preferably the buffer includes at least a second energy absorber acting between the first and second buffer elements.

In such an embodiment preferably the buffer is extensible from an intermediate position to an extended position. Such extension preferably causes absorption of draft forces through operation of the second energy absorber.

Conveniently the buffer includes a first rigid connector connecting the first energy absorber and the first buffer element and a second rigid connector connecting the second energy absorber and the second buffer element.

In such an arrangement preferably the first buffer element includes a moveable engagement member that on compression of the buffer from the intermediate position compresses the first energy absorber against the action of the first rigid connector; and also preferably the moveable engagement member on extension of the buffer from the intermediate position compresses the second energy absorber against the action of the second rigid connector.

The foregoing features advantageously assist in the operation of embodiments of the invention in which first and second energy absorbers are present.

Preferably at least the second energy absorber is or includes a ring spring. The first energy absorber may also be a ring spring although this is unlikely to be the case. More generally it is possible for other types of energy absorber to constitute the first and second energy absorbers, including hydraulic energy absorbers, gas springs, rubber springs, polymer springs and hybrid absorbers that are combinations of e.g. the hydraulic and ring spring types. Moreover as suggested above it is not necessary that in all embodiments of the invention the first and second energy absorbers are the same as one another.

BRIEF DESCRIPTION OF THE DRAWINGS

There now follows a description of preferred embodiments of the invention, by way of non-limiting example, with reference being made to the accompanying drawings in which.

DETAILED DESCRIPTION

Figure 1:
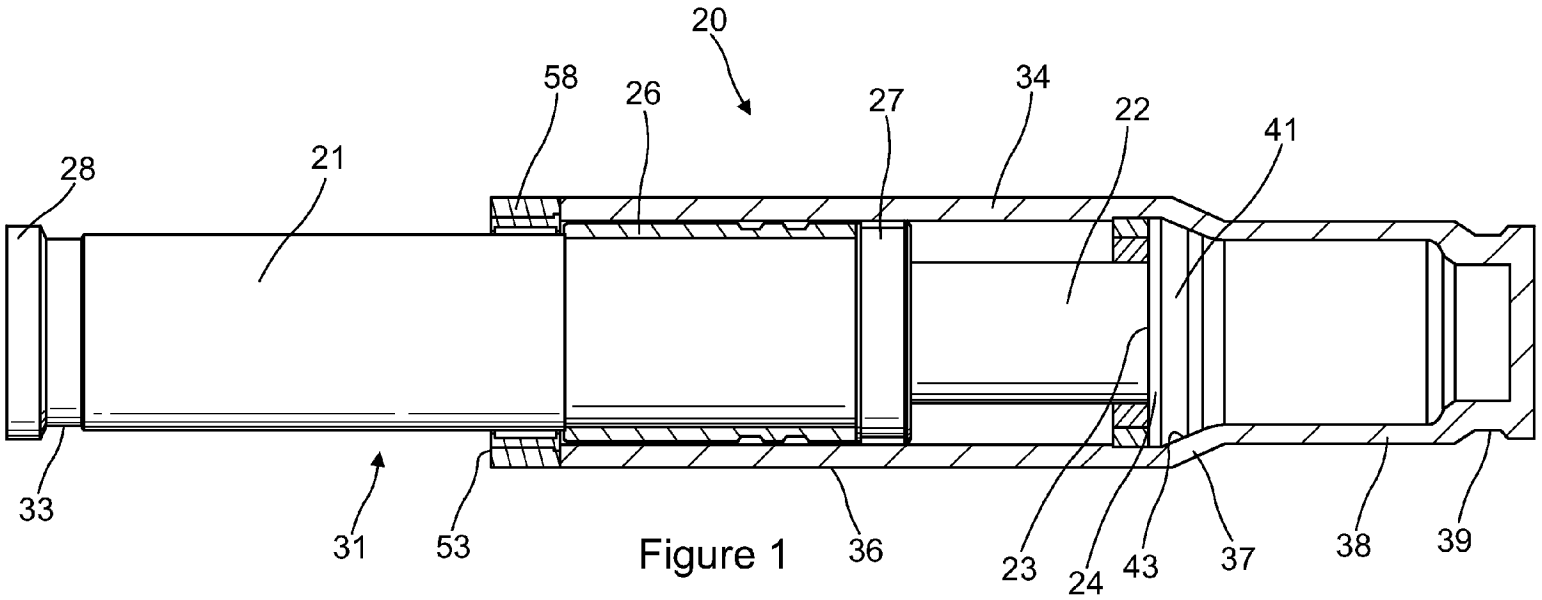
FIG. 1 is a longitudinally sectioned view of a first embodiment of a buffer according to the invention.

Referring to the drawings and initially FIG. 1 there is shown in longitudinally sectioned view a first embodiment of buffer 20 according to the invention.

Buffer 20 includes a first, elongate, hollow buffer element 21 inside an interior of which is slideably received a second, elongate, buffer element 22 via an open end of buffer element 21 designated by numeral 27 in the drawings. First buffer element 21 over the major part of its interior length is a rigid, plain, hollow cylinder, inside which the rigid second buffer capsule element 22 is a sliding fit. The exterior of second buffer element 22 is also a plain cylinder over the major part of its length, such that when accommodated by way of sealing members that are not visible in FIG. 1 the first 21 and second 22 buffer capsule elements constitute an energy absorber in the form of a buffer capsule designated generally by numeral 31.

In the buffer capsule 31 the first buffer element 21 overlaps the exterior of the second buffer capsule element 22 over part of its length. The extent of the overlap is variable, in the manner of per se known buffer capsules. Thus the buffer elements 21, 22 are slideable between the extended configuration shown in FIG. 1 and a second, compressed configuration in which the degree of overlap of the first and second buffer elements is greater than that shown in FIG. 1.

The length of the overlap in the uncompressed configuration is sufficient to ensure that during compression of the buffer capsule 31 the elements 21 and 22 remain aligned with one another and the capsule does not distort laterally even if a compressing force is not properly aligned with the longitudinal axis of the capsule 31.

By reason of its external shape buffer capsule 31 is designed also to be longitudinally received inside the interior of an elongate, hollow non-recoverable energy absorbing member 34 described in more detail below. Over the major part of its length therefore non-recoverable energy absorbing member 34 is a hollow cylinder the internal diameter of which is a sliding fit relative to the external diameter of first buffer element 21.

In the preferred embodiment shown the external diameter at open end 27 of first buffer element 21 is designed to be a snug fit inside the non-recoverable energy-absorbing member 34. End 27 in some embodiments of the invention is fitted with a bearing. In other embodiments of the invention other ways of achieving the desired sliding fit of first buffer element 21 inside non-recoverable energy absorbing member 34, as would occur to the person of skill in the art, may be employed.

As noted herein, the term "non-recoverable energy absorbing member" is intended to refer to an element such as but not limited to a deforming tube that when caused to operate absorbs energy in a manner that irreversibly alters the member in question.

In particular such irreversible alteration of the member occurs by plastic deformation of a metal from which the member is formed. Plastic deformation in this context includes ironing of the material of the member, machining of such material, or other deformation processes.

The buffer capsule 31 may include numerous internal components for the purpose of providing controlled, predictable dissipation of energy in the event of compression caused by low-energy impacts of the kind described above. In the preferred form of the invention the buffer capsule 31 absorbs the energy using e.g. a hydraulic or fluid elastomer medium, these terms being familiar to the person skilled in the art.

The buffer capsule 31 is fully recoverable (as understood in the buffer art) and resets itself after having absorbed the relatively low-energy impact forces.

As is apparent from FIG. 1 the end 28 of first buffer element 21 is exposed on the exterior of the buffer 20. This end therefore is available for connection to a further member.

In the embodiment shown end 28 is formed with at least one groove 33 that is spaced a short distance from the free end of the element 21. Groove 33 together with the circular shape of the remainder of the end 28 constitutes in the preferred embodiment a so-called "muff" end. This is suitable for engagement by a retainer annulus of a muff coupler having a pair of circular ridges formed on its interior surface for the purpose of engaging the groove 33 illustrated and a similar groove formed in another muff-type connector defined in another component to which the buffer 20 may be coupled.

In typical applications of the buffer 20 the further component is another buffer, but in other applications the buffer 20 may be coupled to a range of other structures including, but not exclusively, pivot joints or coupling heads As explained above non-recoverable energy absorbing member 34 in the form of a further, elongate hollow essentially cylindrical member overlies part of the length of the buffer capsule 31, so as to encircle first and second buffer elements 21, 22. In the example shown in FIG. 1 the cylindrical non-recoverable energy absorbing member 34 is a deforming member made from a material, such as a steel alloy, that deforms plastically when subject to sufficiently high-energy impacts.

At one end 53 non-recoverable energy absorbing member 34 is open and includes secured to its interior surface an annulus 58 the inner diameter of which defines a sliding fit over the exterior of the first buffer element 21.

The non-recoverable (deforming) energy absorbing member 34, at least as regards its operational parts as described below, lies between the ends of the overall buffer 20 as represented approximately by groove 33 and a further groove 39 fixed to the end of the cylindrical deforming member 34 that lies opposite end 53, as described below.

In the illustrated embodiment over approximately two-thirds 36 of its length the internal diameter of the cylindrical member 34 is sufficiently large as to accommodate the diameter of the first buffer element 21. This large-diameter section 36 of the cylindrical non-recoverable energy absorbing member 34 tapers by way of an annular, internal taper 37 to define a reduced-diameter cylindrical portion 38.

The free end of the cylindrical non-recoverable energy absorbing member 34 lying remote from the end 28 of buffer element 22 is formed as a muff end including groove 39 that is of similar design to groove 33. Consequently the two ends of the buffer 20 are formed with similar or identical muff couplings so that the buffer may be employed in a range of situations in which it is desired to couple e.g. two vehicles one to the other.

The internal diameter of reduced-diameter portion 38 of non-recoverable energy absorbing member 34 is sufficiently large to accommodate the exterior of the second buffer element 22 in a sliding fit, but for reasons explained below the second buffer element 22 is receivable in the reduced diameter portion only when a sufficiently high-energy impact acts on the buffer 20 as to cause plastic deformation of the material of the cylindrical impact member 34.

At or near its closed end 24 second buffer element 22 includes connected thereto a circular taper member 41 having a tapered surface 43 the diameter of which reduces in the direction towards reduced diameter portion 38.

The diameter of taper member 41 at its greatest as illustrated is the same as that of at least end 27 of first buffer element 21. The shape of the tapered surface is complementary to that of the taper 37 in the interior surface of non-recoverable energy absorption member 34.

Taper member 41 may be formed in several ways, e.g. as a cylindrical tapered disc against the side of which opposite the tapered surface 43 an end face 23 of second buffer capsule member 22 bears or is secured in order to react forces acting between the buffer capsule member 21 and taper member 41 as further described below.

FIG. 1 shows one form of this arrangement within the scope of the invention.

Figure 1A:
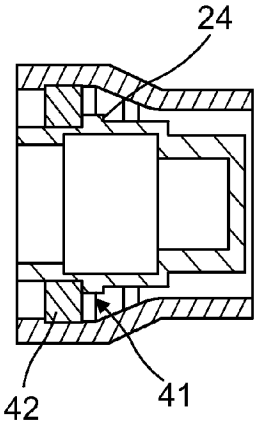
FIG. 1*a* is a cross-sectional view of part of the embodiment of FIG. 1, illustrating an alternative arrangement for mounting of a taper member forming part of the buffer of the invention.

Alternatively, the arrangement may be such that the outer cylindrical wall of buffer element 22 provides a surface for the reaction of forces acting between the buffer element 22 and the taper member 41. In such a case, as illustrated in FIG. 1*a*, the taper member 41 is secured to the outer cylinder wall of buffer capsule element 22 by any of a range of means. These include threading, welding and shrink fitting, and in the preferred embodiment illustrated a step change in the diameter of second buffer member 22 provides a reaction surface 24 as illustrated. This arrangement has the additional advantage of further optimising the available space inside buffer 20.

In normal use of the buffer 20 (i.e. when the relatively low energy impact forces described above act between its ends) a load is applied to buffer capsule 31 and taper member 41 reacts the applied load through contact with taper 37. This prevents the second buffer element 22 from advancing inside the reduced-diameter portion 38 of the deforming member 34 with the result that at such times the buffer capsule 31 operates in the normal manner of such components. Thus the buffer capsule 31 resists buff forces (and, if it is of a design that permits this, draft forces as well) in a recoverable manner.

Taper member 41 is secured against movement towards buffer element 21 by any of a range of means. In the preferred embodiment illustrated, a taper member key 42 (see FIG. 3) engages the rear face of taper member 41, that lies remote from internal taper 37, and is simultaneously secured to the interior of the large-diameter section 36 of cylindrical member 34.

If as is the case in some embodiments of the invention second element 22 is secured to taper member 41, key 42

(which may itself be formed as an annulus, a plurality of discrete blocks or a range of other structures) serves in addition to prevent the energy absorber 31 from being separated from non-recoverable energy absorber 34. In such a case key 42 also provides a reaction force when energy absorber 31 operates to attenuate draft forces.

In the preferred embodiment of the invention taper member 41 is formed from a material that has a harder surface than the material of cylindrical deforming member 34. A range of metal alloys therefore is suitable for the construction of the taper member 41.

The arrangement of the components of the buffer is such that in normal use when the buffer is subject to relatively low-energy impact forces, that for example arise during normal travel of a railway train, the taper member 41 is held rigidly in place by reason of engagement of tapered surface 43 with internal taper 37 reacting buff forces, and optional keying or other securing of the taper member relative to the non-recoverable energy absorbing member 34 resisting any draft forces that act in the opposite sense to buff forces in some embodiments of the buffer.

During such a mode of operation the buffer capsule 31 absorbs and dissipates buff (compression) forces (and depending on its precise design may also dissipate draft (tensile) forces) of low energy levels. Following such energy absorption in buff the buffer capsule 31 by reason of including an internal restoring mechanism such as any of a range of spring types restores the buffer 20 from a compressed configuration to its original length.

In the preferred embodiment shown in FIG. 1, draft forces are absorbed by way of a ring spring 26 acting between the end 27 of buffer element 21 and end 58 of member 34. Following such energy absorption in draft the ring spring 26 restores the buffer 20 (in the opposite sense to the internal spring) from an extended configuration to its original length.

If a high-energy impact occurs (e.g. as may occur at higher impact velocities, such that occur during a crash) it typically is of a high-frequency, impulse type such that the buffer capsule 31 cannot absorb all the energy and the force imparted to tapered member 41 exceeds the threshold level required to deform the non-recoverable energy absorbing member 34. In consequence a high-energy impact force transfers via the length of the buffer capsule 31 to the taper member 41. The interengagement of the components in the vicinity of the taper member 41 means that the impact energy is transferred via the tapered surface 43 to the internal taper 37 of the member 34.

Assuming the buffer 20 has been appropriately designed this transferred force is sufficient to initiate plastic deformation of the member 34 in the vicinity of the internal taper 37.

This in turn causes the taper in member 34 to travel under the influence of the impact force along the length of the reduced diameter portion 38 towards the end defining groove 39. Such plastic deformation dissipates the energy of the impact predictably and safely.

Following absorption of the energy of an impact through deformation of the cylindrical non-recoverable energy absorbing member 34 the latter must be replaced; but if the buffer capsule 31 and the taper member 41 are correctly designed these may be re-used, or at least only the taper member 41 and its fixings would require replacement. In consequence most of the parts of the buffer 20 remain serviceable even following a somewhat severe impact.

Figure 2:
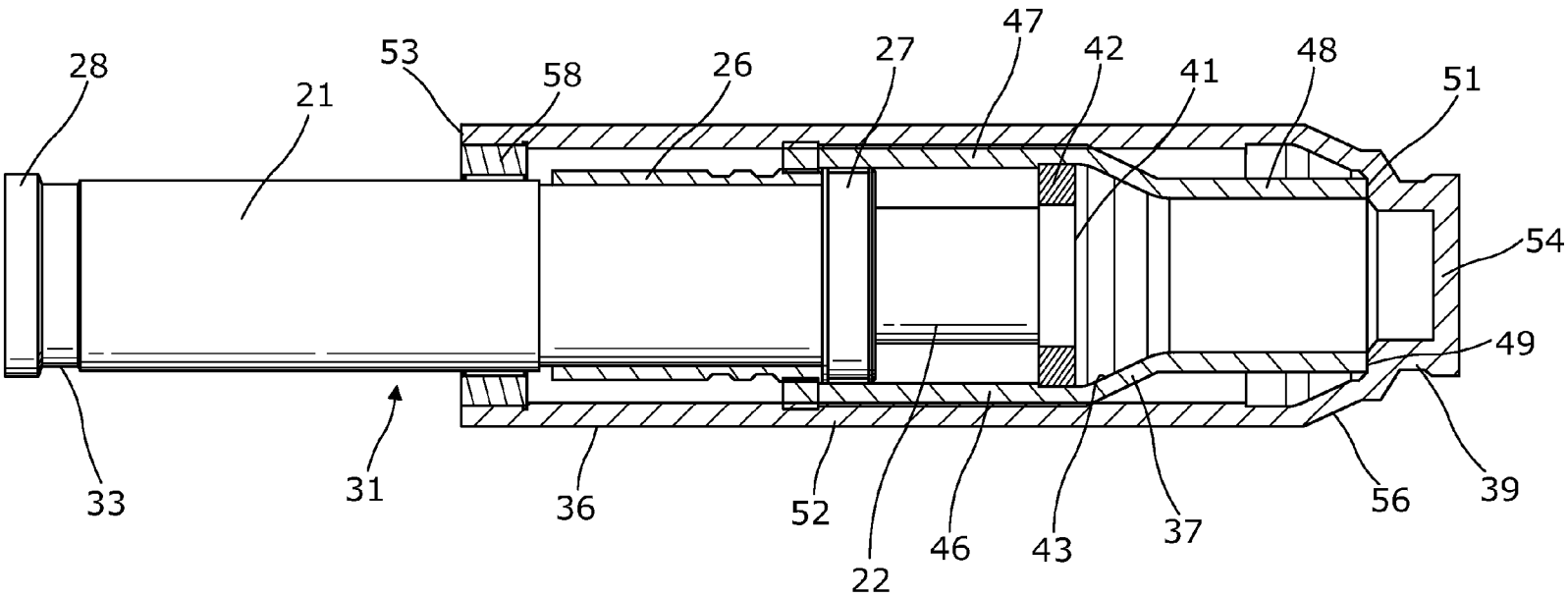
FIG. 2 is a similar view to FIG. 1, showing a second embodiment of a buffer according to the invention, in its uncompressed state and before being deformed by a relatively high-energy impact.

FIG. 2 shows in a similar view to FIG. 1 a variant on the FIG. 1 embodiment.

Like components and sections of the buffer capsule 31 of FIG. 2 have the same reference numbers as their counterparts in FIG. 1 and are described herein in detail only to the extent that their arrangement and/or functioning differs from the FIG. 1 embodiment.

In FIG. 2 a buffer 20 comprises first and second buffer capsule elements 21, 22 that are configured similarly to the counterpart components of FIG. 1 to define a buffer capsule 31 that is operable to dissipate low-energy buff and (optionally, depending on the internal design of the capsule) draft forces. A ring spring 26 in like manner to the ring spring 26 of FIG. 1 absorbs draft energy in versions in which draft attenuation features are not built into the buffer capsule.

At its closed end the first buffer 22 includes secured thereto a taper member 41 that may be of similar design to taper member 41 of FIG. 1.

The tapered surface 43 of taper member 41 bears against the internal taper 37 of a cylindrical non-recoverable energy absorption member 46 that differs from member 34 visible in FIG. 1.

Member 46 includes an enlarged-diameter portion 47 that tapers to a reduced diameter portion 48. Enlarged-diameter portion 47 overlies the first buffer element 21 over only a relatively short part of its length however; and the end of reduced diameter portion 48 omits the muff end parts described above in relation to the member 34 of FIG. 1.

Instead cylindrical member 46 terminates in an open end 51 that bears against a shoulder 49 defined internally at one end 54 of an elongate, hollow, cylindrical shroud member 52.

In the vicinity of end 54 the exterior of shroud 52 defines in the embodiment shown a muff coupling that includes a groove 39 of similar or identical design to that of groove 39 visible in FIG. 1. In other embodiments of the invention other forms of coupling than the muff coupling illustrated may be employed at either end of the buffer 20.

Shroud member 52 encircles the other components of the buffer 20 of FIG. 2 over approximately two thirds of its length, and includes an internal diameter that is large enough to overlie the other components with the enlarged diameter portion 47 of member 46 in sliding contact with its interior surface. Optional features include that the muff coupling of shroud member 52 is of lesser diameter than an enlarged diameter portion 47, and that the resulting change in diameter is accommodated internally and externally by a taper 56 of complementary design, at least on the interior of shroud member 52, to the taper of member 46. Other muff sizes and shapes than those illustrated and described are possible within the scope of the invention, however, as would naturally be well-known to the person of skill in the art.

At its end 53 remote from the muff coupling including groove 39 shroud member 52 is open and includes secured to its interior surface an annulus 58 the inner diameter of which defines a sliding fit over the exterior of the first buffer element 21. Since the shroud 52 overlaps a considerable length of the first buffer element 21 even when the buffer capsule elements 21, 22 adopt the extended configuration shown in FIG. 2 the buffer 20 overall is effectively stabilised against unwanted lateral relative movement of its parts even if an impact force does not act directly in line with the longitudinal axis of the buffer 20. The stability of the buffer is achieved because of the distance between the described short overlap at end 27 of the buffer element 22 and end 53 of the shroud member 52. Either or both ends of the shroud 52 may contain a bearing or other stabilising feature; or depending on the precise designs they may omit such features.

The taper 56 of shroud 52 is spaced longitudinally along the buffer 20 in the direction of groove 39 from taper 37 of member 34. This means that in the configuration shown in FIG. 2 there exists an annular space inside the shroud member 52 between the external surface of taper 37 and the internal surface of taper 56. When as described below the buffer 20 of FIG. 2 suffers a high-energy impact this space accommodates movement of the taper 37 in the longitudinal direction under the influence of taper member 41.

The buffer 20 of FIG. 2 operates similarly to that of FIG. 1 when considering relatively low-energy impacts as described herein. Under such circumstances the energy absorber defined by the first and second buffer capsule elements 21, 22 attenuates buff forces in a predictable manner. The buffer elements 21, 22 move from the relatively extended position shown to a relatively retracted position during such actions. Energy stored as a result within the buffer capsule 31 in a per se known manner restores the capsule from a compressed configuration to its extended position.

If however the buffer 20 of FIG. 2 suffers a relatively high-energy impact the buffer capsule 31 cannot absorb all the energy and the force imparted to tapered member 41 exceeds the threshold level required to deform the non-recoverable energy absorbing member 46. As a result the impact force is transmitted between the ends 28 and 54 respectively of the first buffer element 21 and the shroud member 52.

Since the non-recoverable energy absorbing member 46 is in contact with the end 54 of shroud member 52 the impact force drives the taper member 41 attached to first buffer element 21 in deforming contact with the taper 37 of non-recoverable energy absorbing member 46. This in turn leads to deformation of the non-recoverable energy absorbing member 46 in a mode that causes the taper 37 to travel longitudinally along the buffer 20 towards end 54 of shroud member 52.

As indicated, during such deformation of the deforming member 46 any overlap of the first 21 and second 22 buffer elements, and the overlap of the shroud 52 and buffer element 21 along the length of the buffer, maintain lateral stability of the buffer even if the impact force is off-centre or otherwise not aligned with the longitudinal axis of the buffer 20.

Figure 3:
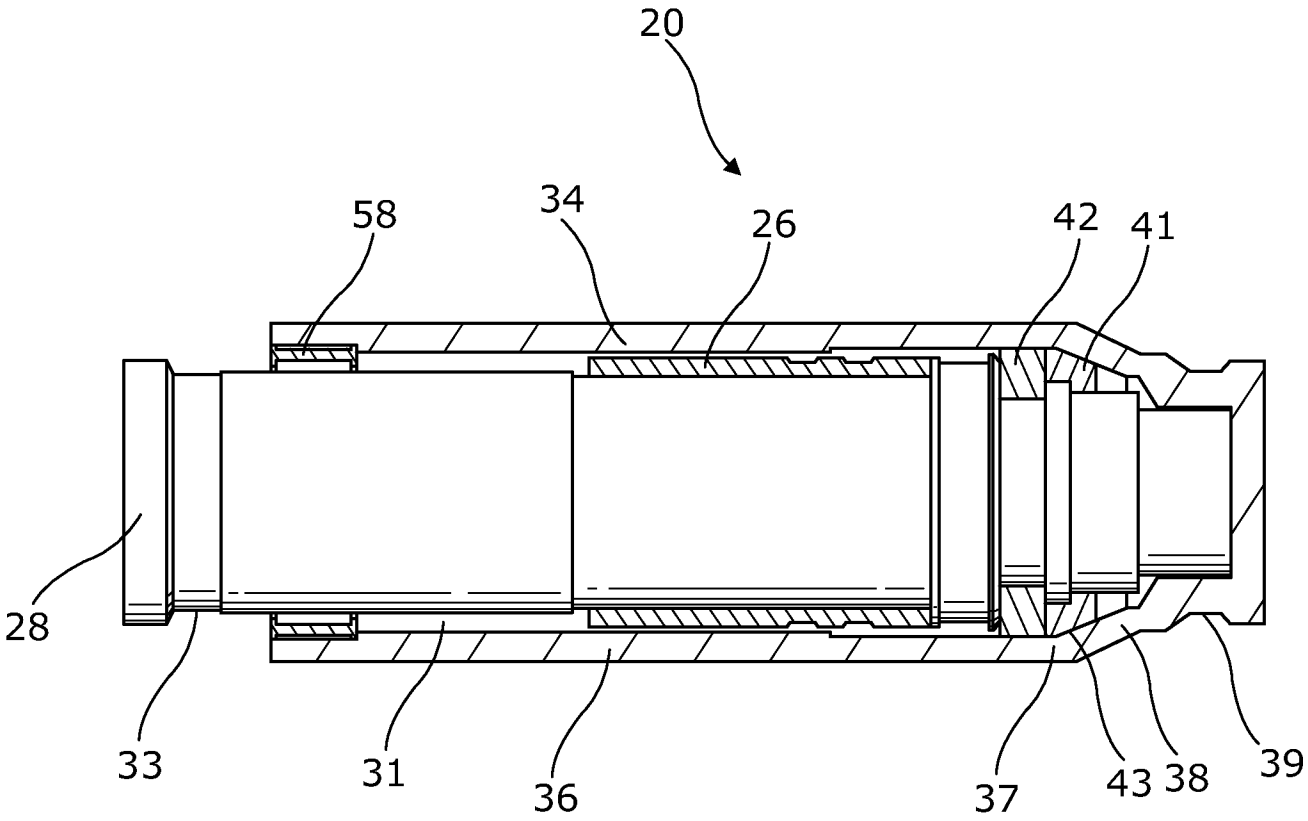
FIGS. 3 and 4 show the FIGS. 1 and 2 buffers respectively following compression in high-energy impacts.
Figure 4:
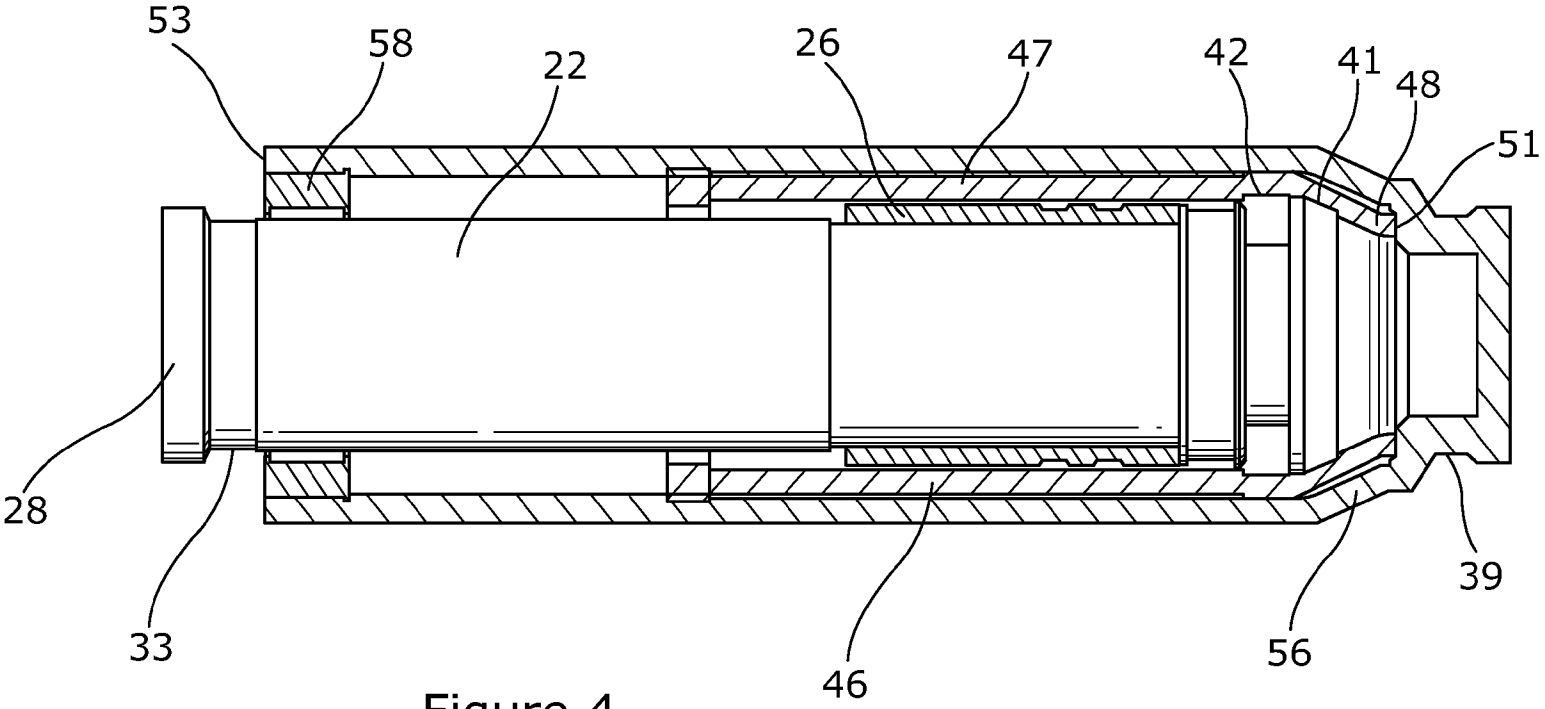

FIGS. 3 and 4 show the results of the compression and deformation processes that result when the buffers 20 of FIGS. 1 and 2 experience relatively high-energy impacts that are sufficient to cause deformation of the non-recoverable energy absorbing members 34 and 46 respectively.

As is apparent from FIG. 3 the buffer capsule 31 in this case has compressed to its fully retracted position (although this may not necessarily happen each time a high-energy impact is attenuated); and taper 37 has travelled along the non-recoverable energy absorbing member 34 eliminating the reduced diameter portion 38 in the process. During such advancing of the taper 37 the material of the non-recoverable energy absorbing member 46 expands as illustrated.

Once the buffer 20 attains the condition shown in FIG. 3 it is necessary to replace the non-recoverable energy absorbing member 34 before the buffer 20 can be re-used; but in the majority of cases this is expected to be all that is required to render the buffer once again available for use.

In FIG. 4 since the shroud member 52 additionally encircles the buffer over part of its length when the buffer 20 occupies its extended position, once compression of the buffer 20 occurs most of the internal parts lie entirely inside the shroud member 52 with only the groove 33 of buffer capsule 31 remaining exposed. The shroud member 52 in this way protects the remainder of the buffer 20 against unwanted deformation, and contamination.

Following compression of the buffer 20 to the state shown in FIG. 4 it would normally be the case that after replacement of the non-recoverable energy absorbing member 46 (in turn following temporary removal of the shroud member 52) the buffer 20 would be ready for re-use.

Of course there may arise high energy impacts that initiate deformation of the non-recoverable energy absorption members without the tapers travelling the whole lengths indicated in FIGS. 3 and 4 before adequate energy attenuation is effected. In such cases the appearances of the used buffers may differ from the forms illustrated. Attenuation of forces by such partial travel of the tapers is within the scope of the invention.

In preferred embodiments of the invention the capsule 31 is a hydraulic buffer capsule. A range of designs of such devices is known. Hydraulic buffer capsules include labyrinthine fluid flow paths and combinations of valves that cause the conversion of low-speed impact forces to heat thereby attenuating the waveform of the impact energy safely. The energy store in such a capsule typically is a gas spring of a length that is variable depending on the degree of compression of the capsule 31. The gas spring as indicated restores the capsule 31 to its full length after a low-speed compression force ceases acting.

Typically the parts of the buffers of the invention, other than those described herein as being resiliently deformable or consisting of fluids, are made from metal alloys such as but not limited to steels. Resiliently deformable parts may be made from any of a range of elastomeric or similar materials.

Figures 5, 5A:
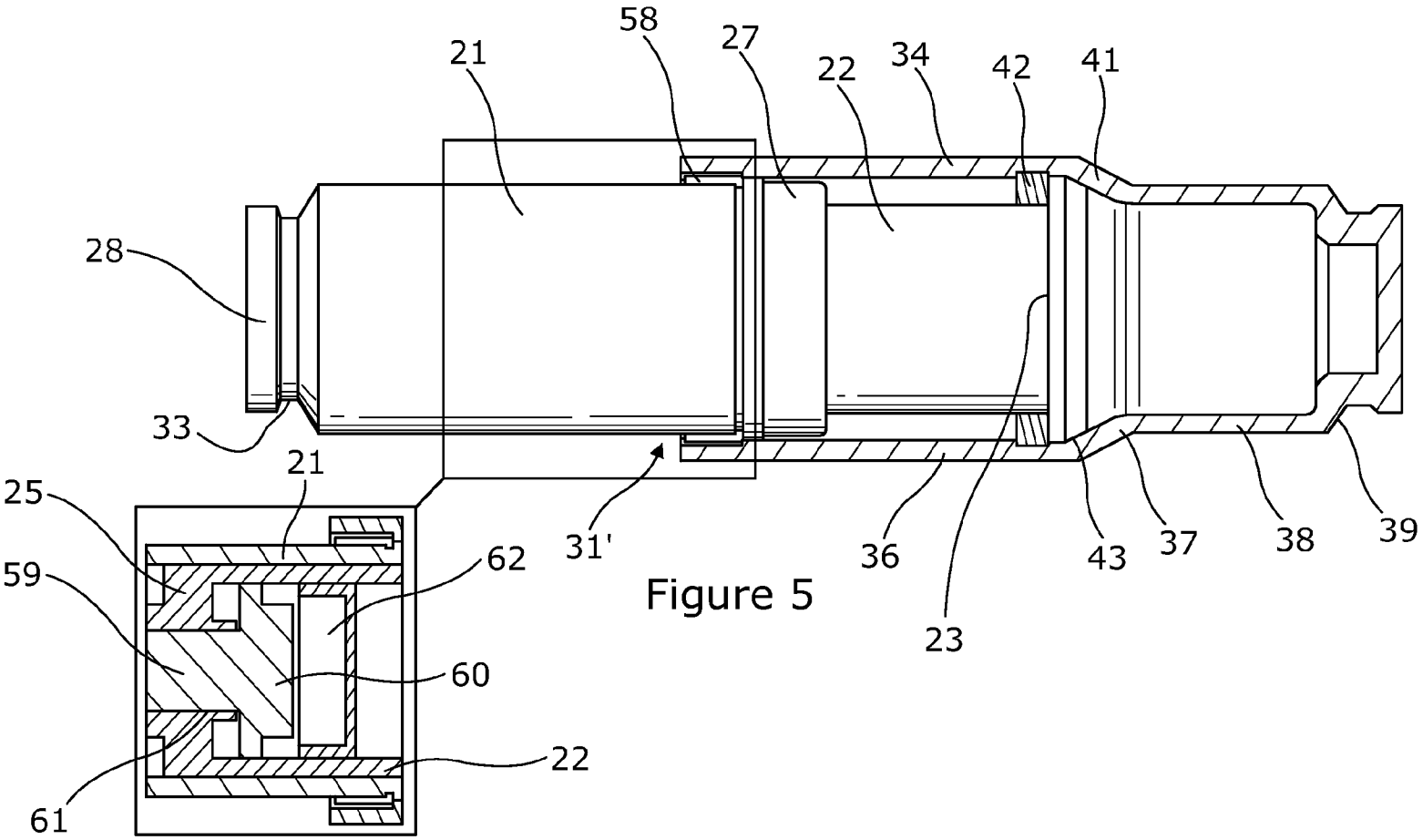
FIG. 5 is a similar view to FIGS. 1 and 2 of a third embodiment of buffer according to the invention, in its uncompressed state and before being deformed by a relatively high-energy impact.
FIG. 5*a* is an enlarged, cross-sectional view of the part of FIG. 5 enclosed in a square.

FIGS. 5 and 5*a* show an exemplary embodiment of the invention including a hydraulic buffer capsule 31', and instead of having a ring spring such as ring spring 26 of FIG. 1 including an alternative arrangement for providing draft energy absorption. In FIG. 5 draft energy absorption features can be incorporated within the buffer capsule 31 described in relation to FIGS. 1-3. The principle of how this can be achieved is shown in longitudinal cross-sectional view in FIG. 5*a*.

In FIGS. 5 and 5*a* the buffer 20 is essentially the same as in FIG. 1, except in two significant respects. Therefore the buffer 20 includes first 21 and second 22 buffer capsule elements that function similarly to the elements 21 and 22 of FIG. 1; a non-recoverable energy absorbing member 34 having an internal taper 37; and a taper member 41 defining an external tapered surface 43 of complementary profile to taper 37.

The hollow interior of the first buffer element 21 includes a hydraulic energy absorber of the general kind described above. Such an energy absorber, precise details of which are omitted from FIG. 5 for clarity, includes as indicated a labyrinthine series of openable paths for a fluid such as hydraulic oil and a series of valves and restrictions that operate in dependence on the direction of a low-level impact force in order to attenuate buff and draft forces.

The energy absorber is indicated schematically by way of a buffer piston 59, that is fixedly secured to the end 28 of buffer element 22. Piston 59 extends via an aperture 61 in the end 25 of second buffer element 22 into the interior of the buffer element 21. Piston 59 is elongate in a direction parallel to the longitudinal axis of the buffer 20.

Compression of the buffer capsule 31' causes hydraulic fluid contained within the volume enclosed by the interior of the first buffer element 21 and the end 25 of second buffer element 22 to be forced via the series of valves and apertures towards end 23 of buffer capsule 31' in a manner that attenuates the energy of low-speed impacts.

FIG. 5 shows the buffer 31' in its fully extended configuration, i.e. following absorption of a draft force acting while the buffer is in a compressed condition as a result of absorbing a prior buff force.

At such a time piston 59 is advanced relative to the position shown inside second buffer element 22 towards closed end 23. This results in an increase in the volume contained between the head of the piston 60, the end 25 and the interior diameter of buffer element 22. This enclosed volume of media such as hydraulic oil together with a labyrinthine series of openable paths for a fluid and/or a series of valves and restrictions that operate as the buffer capsule extends then provides a means of absorbing energy in draft. In order to force the fluid though the valves and/or restriction the draft forces at muff ends 28 and 39 have to be reacted against at the interfaces of the second buffer element 22 with tapered member 41 and taper member key 42.

Buffer element 22 includes an internal, moveable separator piston 62. As shown by FIG. 5*a*, separator piston 62 is moveable inside first buffer element 21 along its length.

A body of a gas such as nitrogen or air is trapped between separator piston 62 and the end 23 of element 22. On operation of the buffer capsule 31' to absorb buff forces the piston 62 moves as shown towards end 23, compressing the gas. This then acts as a gas spring on removal of the compressive force acting on the buffer capsule 31' and tends to restore the capsule 31' to its uncompressed configuration.

During such restoring of the capsule 31' in preferred embodiments of the invention the hydraulic fluid inside the energy absorber is forced in a reverse direction tending to extend the buffer piston 59 outwardly of the first buffer element.

Compression and extension of the buffer capsule 31' take place in this way while the capsule experiences low-energy buff and draft forces.

When a relatively high-energy impact occurs this by reason of its high frequency is transmitted via the capsule 31' such that the taper 43 is forced into engagement with (or if already touching is forced more firmly into engagement with) taper 37, and such that the latter travels along the length of reduced diameter portion 38 of non-recoverable energy absorbing member 34, plastically deforming the latter. This eliminates the reduced diameter portion 38 and simultaneously absorbs the impact energy in a predictable manner that is similar to the operational method of the FIGS. 1 and 2 embodiments of the invention.

The embodiment of FIGS. 5 and 5*a* could if desired be provided in a modified form, that adopts the constructional principles of FIG. 2 in having a cylindrical (or other shape) sleeve or shroud member such as member 52 that overlaps the capsule 31' and defines one of the ends of the buffer 31'. In other words, it is possible to construct the FIGS. 1 and 2 embodiment including an energy absorber of the hydraulic type instead of the ring spring arrangement specified.

Figure 6:
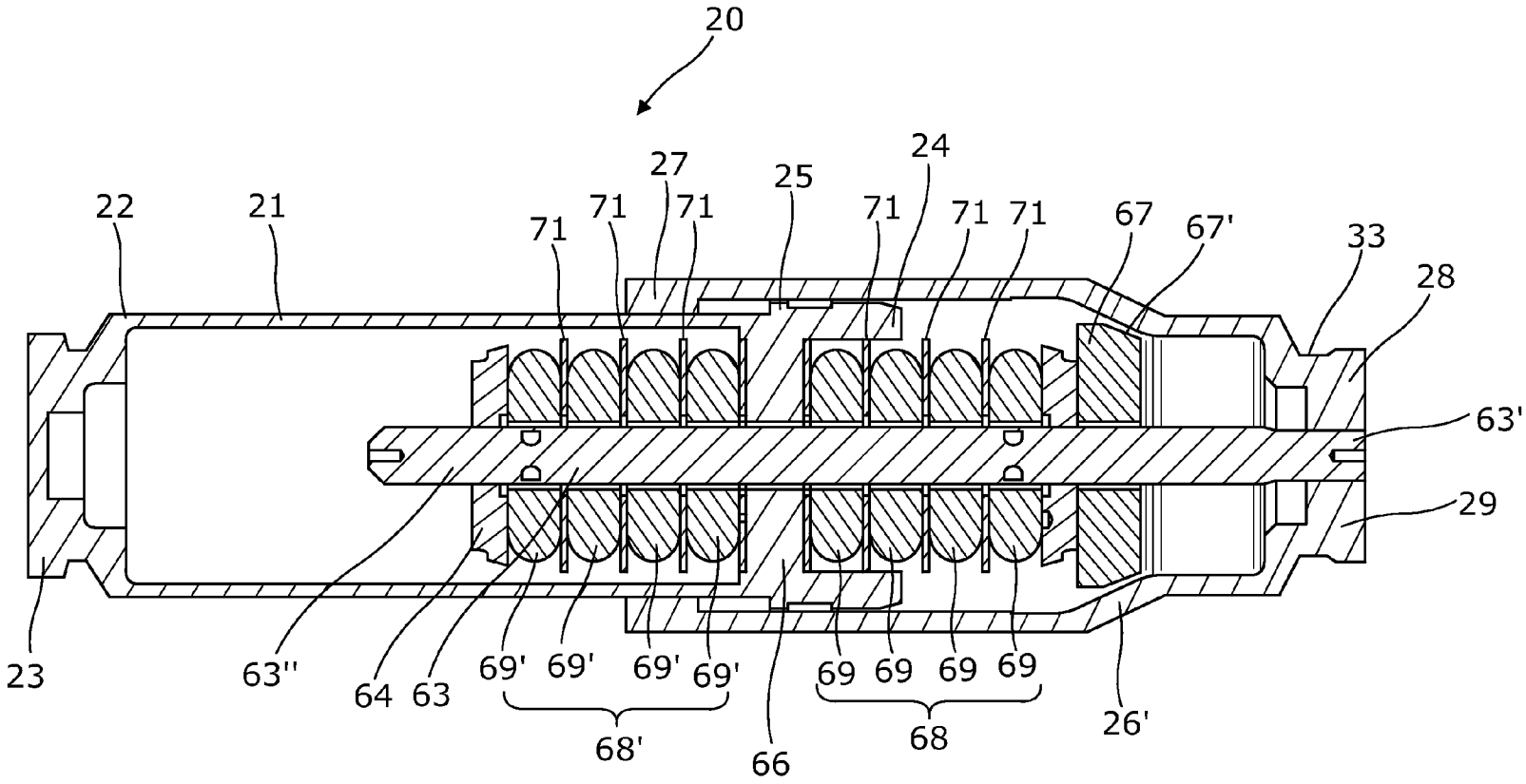
FIG. 6 shows in longitudinal cross-sectional view a further buffer design within the scope of the invention.

Referring now to FIG. 6 there are shown in an intermediate (pre-impact) position a further design of buffer in accordance with the invention.

In FIG. 6 a buffer 20 includes first buffer element 21 formed as a hollow cylinder as illustrated. The cylinder is closed at a first end 22 by a cap 23 in like manner to the FIG. 1 arrangement.

Buffer element 21 is open at a second end 24 that is remote from end 22.

First buffer element 21 is longitudinally slideable inside the interior of a second, elongate, cylindrical hollow buffer element 26 via an open, first end 27 of the latter. The end 28 that lies remote from end 27 is closed by a further end cap 29.

In the illustrated embodiment of FIG. 6 end cap 29 is formed with a muff groove 33 in like manner to the FIG. 1 arrangement.

End cap 23 also is a muff end like end 28. Ends 23 and 28 could equally have alternative means of attaching to additional members or could be plain ends.

As described a rigid spring tie rod 63 is anchored at one end 63' in end cap 29. Tie rod 63 extends away from end 28 to a remote end 63" that lies inside first buffer element 21. In the embodiment shown remote end 63" lies beyond the end 27 of second buffer element 26 when the buffer 20 adopts the position shown in FIG. 6, which by reason of the buffer 20 being able to accommodate buff and draft forces as noted above is herein designated an intermediate position.

Tie rod 63 includes secured at or near end 63" a containment member 64 that may be in the form of a rigid disc or bar extending transversely outwardly on at least two sides, as shown, from the end 63".

Tie rod 63 in the space between end cap 29 and end 63" perforates in a sliding fit a force-transferring crossmember 66.

Crossmember 66 extends from one side of the interior of first buffer element 21 to the other, at a location that is part-way along the length of the element 21.

As in the embodiment of e.g. FIGS. 1 and 2 the buffer elements 21 and 26 normally overlap over parts of their respective lengths. As a result the crossmember 66 in normal use of the buffer 20 is intersected by the tie rod 63 approximately half way along the length of the latter.

Crossmember 66 is rigid and is rigidly secured to first buffer element 21. Between crossmember 66 and a tapered member 67, a buffer spring 68 is trapped such that normal operating force compression of the buffer 20 results in energy attenuation through compression of first spring 68.

As is conventional in the field of buffer springs the first spring 68 includes a series of resiliently deformable annular elements or pads 69.

The annular spring elements 69 are centrally perforated by the tie rod 63 which thereby acts to assure their mutual alignment and correct positioning in the buffer. In the illustrated embodiment the annuli 69 are shown connected one to another by washers 71 that prevent their direct compaction together and thereby assist to maintain the integrity of the spring.

The perforations in the annular spring elements 69 are such as to allow sliding movement of the annuli, during compression and extension of the buffer 20. Large-scale movement of the annuli 69 however is constrained by reason of the annuli 69 being contained between the tapered member 67 and the crossmember 66.

In the embodiment illustrated four of the annular spring elements 69 are shown in a stack between the member 67 and the crossmember 66. In other embodiments of the invention however more or fewer of the annuli 69 may be present.

A similar arrangement of four (in the embodiment shown, although in other embodiments of the invention other members of the annuli 69' may be present) annuli 69' is retained in a moveably captive fashion between the crossmember 66 and the containment member 64 by reason of being perforated centrally by the tie rod 63 in like manner to the annuli 69, and also by reason of being connected by washers 71 that are similar in design to the washers 71 spacing the annuli 69 one from another.

The annuli 69' thereby partially define a draft force spring 68' that is similar to the buff force spring partially constituted by the annuli 69, but with the draft force spring 68' extending on the opposition side of crossmember 66 to the buff force spring.

In the embodiment shown the two springs 68, 68' are the same as each other, with the same number of the annuli and with the annuli being identical in size, shape and construction. It will be appreciated however that variations on such factors are possible within the scope of the invention, with the result that differing characteristics may be conferred on the buff and draft springs 68, 68' as desired.

In the event of compression of the buffer 20 under the influence of relatively low energy forces as explained herein such forces cause compression in buff of the annuli 69 by reason of their being compressed between the crossmember 66 (which is rigidly attached to the first buffer element 21) and the member 67 (which as explained below in low-energy impact situations is rigidly connected to the second buffer element 26).

Such compression of the annuli 69 results in the attenuation of buff forces by reason of the resilient deformability of the annuli 69.

In the event of a draft force of relatively low energy arising the buffer 20 lengthens from the intermediate position shown in FIG. 5 with the result that the annuli 69' become compressed between the crossmember 66 and the containment member 64, while the tie rod 63 is placed in tension that is resisted by reason of attachment of the tie rod 63 to the cap 29. The resilient deformability of the annuli 69' thereby attenuates the draft forces in a similar way to that in which the annuli 69 attenuate buff forces. In the fully compressed state of the draft spring 68' end 25 of buffer element 21 contacts end 27 of buffer element 26 preventing the spring elements from being over-compressed.

In the fully compressed state of the buff spring 68 end 24 of buffer elements 21 contacts member 67 thereby preventing the annular spring elements 69 from being over-compressed, and providing a contact surface permitting the application of greater loads to member 67 than could be sustained by the spring elements 69 above.

During compression of the annuli 69 or the annuli 69' the integrity of the springs is maintained by the stabilising effects of the tie rod 63 and the washers 71.

The design of the spring shown in FIG. 6 may if desired be used in any of the other embodiments of the invention, when these call for the presence of one or more such annular spring.

Member 67 is a rigid disc that is perforated centrally by, and is free to slide along, the tie rod 63.

At its end nearest to end 28 of second buffer element 26 the member 67 is formed to include an annular, leading edge taper 67' that reduces in diameter in a direction towards end 28. This is of complementary profile to a taper 26' formed in the cylindrical wall of second buffer element 26 so as to define the transition between a relatively large diameter part and a relatively small diameter part, nearer end 28, of the second buffer element 26.

In the event of a high energy impact occurring as described herein the annular spring elements 69 compress until contact is made between the open end 24 of the first buffer element 21 and the member 67 with the result that the buff force transmits the impact energy to member 67.

By reason of the engagement of the complementary tapers 67' and 26' this energy is transmitted to the second buffer element 26.

The second buffer element 26 is made from a plastically deformable material such as a steel. As a result the transmitted impact forces cause the taper 26' to travel towards end 28 when a high-energy impact occurs. This attenuates the impact energy in a controllable manner, in a similar fashion to the operation of the other embodiments described herein.

The listing or discussion of an apparently prior-published document in this specification should not necessarily be taken as an acknowledgement that the document is part of the state of the art or is common general knowledge.

The invention claimed is:

1. A coupling buffer or buffer capsule comprising a first, elongate, hollow buffer element inside which is moveably received a second, elongate buffer element such that the first and second buffer elements overlap over part of their length, such that the buffer elements define a hollow interior of the buffer and such that at an end of the buffer at least the first buffer element is exposed for coupling with a respective, further member, the first and second buffer elements being moveable between a first, extended or intermediate configuration of the buffer or buffer capsule and a second, compressed configuration, compression of the buffer more energetically than a threshold energy level causing the second buffer element to energise a non-recoverable energy absorbing member, forming part of the buffer or buffer capsule, to cause deformation of one or more plastically deformable parts of the non-recoverable energy absorbing member, characterized in that the non-recoverable energy absorbing member lies between the ends of the buffer or capsule at least in the region energised by the second buffer element; and in that the buffer includes at least a first energy absorber acting between the first and second buffer elements to absorb buff forces, and the first buffer element is at least partially slidably received in the non-recoverable energy absorbing member before the threshold energy level is reached.

2. A buffer or buffer capsule according to claim 1 wherein the non-recoverable energy absorbing member is or includes a deforming tube.

3. A buffer or buffer capsule according to claim 1 wherein the non-recoverable energy absorbing member lies externally of the second buffer element.

4. A buffer or buffer capsule according to claim 1 wherein the non-recoverable energy absorbing member is plastically deformable and wherein compression of the buffer more energetically than the threshold level causes plastic deformation of the non-recoverable energy absorbing member.

5. A buffer or buffer capsule according to claim 1 wherein compression of the buffer less energetically than the threshold energy level causes buffering of compression forces through operation of the first energy absorber.

6. A buffer or buffer capsule according to claim 1 wherein the non-recoverable energy absorbing member encircles part of the second buffer element.

7. A buffer or buffer capsule according to claim 1 wherein the second buffer element includes formed integrally therewith or secured thereto an annular element taper and wherein the non-recoverable energy absorbing member includes a hollow tube having an internal tube taper of complementary cross-section to the element taper, the element taper and the tube taper being engageable one with the other on compression of the buffer or buffer capsule more energetically than the threshold energy level to cause deformation of the tube commencing at the tube taper.

8. A buffer or buffer capsule according to claim 1 wherein the second buffer element includes formed integrally therewith or secured thereto an annular element taper and wherein the non-recoverable energy absorbing member includes a hollow tube having an internal tube taper of complementary cross-section to the element taper, the element taper and the tube taper being engageable one with the other on compression of the buffer or buffer capsule more energetically than the threshold energy level to cause deformation of the tube commencing at the tube taper, the buffer capsule including an annular taper member encircling the second buffer element in order to define the element taper.

9. A buffer or buffer capsule according to claim 1 wherein the second buffer element includes formed integrally therewith or secured thereto an annular element taper and wherein the non-recoverable energy absorbing member includes a hollow tube having an internal tube taper of complementary cross-section to the element taper, the element taper and the tube taper being engageable one with the other on compression of the buffer or buffer capsule more energetically than the threshold energy level to cause deformation of the tube commencing at the tube taper, and wherein the exterior of the non-recoverable energy absorbing member tapers generally parallel to the tube taper inside the non-recoverable energy absorbing member.

10. A buffer or buffer capsule according to claim 1 wherein the first buffer element includes a coupler for coupling its exposed end to a further member.

11. A buffer or buffer capsule according to claim 1 wherein the non-recoverable energy absorbing member includes a coupler for coupling an end of the buffer or buffer capsule to a further member.

12. A buffer or buffer capsule according to claim 1 including a cylindrical hollow shroud encircling the non-recoverable energy absorbing member over at least part of its length.

13. A buffer or buffer capsule according to claim 1 including a cylindrical hollow shroud encircling the non-recoverable energy absorbing member over at least part of its length, and wherein the cylindrical shroud includes a coupler for coupling and end of the buffer to a further member, the shroud being connected to the non-recoverable energy absorbing member.

14. A buffer or buffer capsule according to claim 1 wherein the first buffer element includes a coupler for coupling its exposed end to a further member and wherein at least the said coupler of the first buffer element is a muff-type coupler.

15. A buffer according to claim 1 wherein the first energy absorber is or includes a hydraulic buffer capsule that interconnects the first and second buffer elements inside the buffer.

16. A buffer or buffer capsule according to claim 1 wherein the first energy absorber includes an energy store.

17. A buffer or buffer capsule according to claim 1 wherein the first energy absorber includes an energy store; and wherein the energy store is or includes a resiliently deformable spring acting between the first and second buffer elements inside the interior of the buffer.

18. A buffer or buffer capsule according to claim 1 wherein the first energy absorber includes an energy store: wherein the energy store is or includes a resiliently deformable spring acting between the first and second buffer elements inside the interior of the buffer; and wherein the spring includes a gas spring and/or a ring spring.

* * * * *